US006061933A

United States Patent [19]

Rogge

[11] Patent Number: 6,061,933

[45] Date of Patent: May 16, 2000

[54] COMPACTOR FOR USE WITH BACKHOE METHOD AND APPARATUS

[76] Inventor: Steven Dean Rogge, 516 W. Harvest Dr., Lincoln, Nebr. 68521

[21] Appl. No.: 08/840,416

[22] Filed: Apr. 29, 1997

[51] Int. Cl.[7] ..... E02F 3/96

[52] U.S. Cl. ..... 37/403; 37/466; 414/912; 173/112

[58] Field of Search ..... 37/403, 468, 399, 37/397, 401, 466, 904; 414/912, 607, 626, 629, 631, 641, 663, 525.2; 241/273, 233; 173/112, 60; 405/232; 254/394, 398

[56] References Cited

U.S. PATENT DOCUMENTS

| | | | |
|---|---|---|---|
| 27,633 | 3/1860 | Hovey | 254/394 |
| 44,409 | 9/1864 | Doyle | 254/394 X |
| 290,606 | 12/1883 | Simpson | 241/273 X |
| 465,153 | 12/1891 | Bloomer | 241/273 |
| 693,881 | 2/1902 | Morgan | 254/394 X |
| 801,367 | 10/1905 | Davidson | 254/394 |
| 1,579,330 | 4/1926 | Long et al. . | |
| 1,719,278 | 7/1929 | Powell . | |
| 2,646,225 | 7/1953 | Te Desco . | |
| 2,803,445 | 8/1957 | Borrowdale | 241/273 X |
| 3,155,328 | 11/1964 | Longley | 241/273 X |
| 3,743,030 | 7/1973 | Gifford . | |
| 3,827,508 | 8/1974 | Mackinnon | 173/112 |
| 4,151,888 | 5/1979 | Jansz | 173/60 |
| 4,293,269 | 10/1981 | Zook | 414/607 X |
| 4,371,041 | 2/1983 | Becker et al. | 172/28 |
| 4,626,138 | 12/1986 | Boyes | 405/232 |
| 4,934,660 | 6/1990 | Nelson | 254/394 |
| 5,558,285 | 9/1996 | Basanen | 241/273 |

FOREIGN PATENT DOCUMENTS

| | | | |
|---|---|---|---|
| 637381 | 5/1950 | United Kingdom | 254/398 |

*Primary Examiner*—Victor Batson
*Attorney, Agent, or Firm*—Vincent L. Carney

[57] ABSTRACT

To compact soil, an impact apparatus includes a weight within a steel frame that may be carried by a vehicle mounted backhoe and placed over the surface to be compacted or broken. The weight is lifted and released by a cable. To pull the cable, a hydraulic cylinder pushes one set of pulleys upwardly away from another set with the upper set of pulleys including five pulleys and the lower set including four pulleys to provide a multiplication factor. The end of the cable opposite the end attached to the weight is attached to the movable pulleys, all of which are mounted at an elevation higher than the fixed pulleys so that the pulley assembly, the attached cable end, the hydraulic cylinder ram and piston, and the weight fall downwardly under the force of gravity.

1 Claim, 5 Drawing Sheets

10
12
14
16
18
20
22
24
26
28
30
32
34
36
38
40
42
44
46
48
50
52
54
62
70

COMPACTOR FOR USE WITH BACKHOE METHOD AND APPARATUS

BACKGROUND OF THE INVENTION

This invention relates to apparatus for compaction such as for example tamping ground over excavations and more particularly to compaction apparatus and method usable with backhoes.

One class of equipment for tamping earth includes an excavation vehicle carrying a backhoe or the like that articulates a weight. It raises and drops the weight and thus tamps earth down or breaks objects beneath it. This class of compaction or crushing equipment includes a frame with a weight mounted within it and hydraulic cylinders that provide power to lift the weight and permit it to drop. For this purpose, the weight is connected by an elongated member such as a cable to the piston of the hydraulic cylinder. The elongated member is wound over pulleys to provide increased distance of movement as compared to the distance of movement of the piston, and to cause the elongated member to be above the impact area for the weight. The end of the cable is attached to the weight to lift the weight and permit it to drop as the piston is articulated by the hydraulic cylinder. Typically, the excavation vehicle and backhoe are used for other purposes and the compaction apparatus is an attachment.

In one type of prior art compaction apparatus in this class, the pulleys are mounted at stationary locations on the frame so that the movement of the piston pulls the cable over pulleys that rotate but does not move the pulleys with respect to the frame of the compaction or crushing apparatus. This type of tamping apparatus has a disadvantage in that the momentum of the weight hitting the impact surface is reduced excessively by frictional resistance, particularly from the cable pulley wheels and piston of the hydraulic cylinder.

SUMMARY OF THE INVENTION

Accordingly, it is an object of the invention to provide a novel apparatus and method for compaction.

It is a still further object of the invention to provide novel compaction apparatuses that can be easily moved from place to place with standard backhoes that may be used for other purposes.

It is a still further object of the invention to provide a method for reducing lost energy from a dropping weight in compaction.

It is a still further object of the invention to provide an apparatus for compaction that offsets frictional losses during an impaction cycle.

In accordance with the above and further objects of the invention, a compaction system includes an impaction assembly that has a frame positionable above an impact surface, such as by a backhoe or the like, and has a movable weight mounted within the frame for elevation and dropping. A hydraulic cylinder is mounted to the frame and communicates with a source of hydraulic pressure, with its piston being adapted to move a set of independently rotatable pulleys vertically, upwardly away from a cooperating set of pulleys having a stationary axis and in juxtaposition with the frame. The movable pulley assembly is mounted to the piston in such a manner that extension of the piston under hydraulic pressure elevates the impaction weight and retraction of the piston permits both the weight and the movable set of pulleys to drop downwardly, being pulled by the force of gravity. The pulley arrangement permits a small movement of the piston to cause a large movement of the weight.

A solenoid activated hydraulic relief valve controls the extension and retraction of the piston, this valve being a relief valve that opens to permit the flow of hydraulic fluid from a piston cyclinder during the impact portion of a cycle while the weight falls to the impact surface and closes the valve to cause the piston to be extended and to lift at least one of the pulleys and the weight upwardly.

This method and apparatus has several advantages, such as: (1) it can be used with standard backhoes to avoid increased capital expenditures; (2) the weight of the pulley aids in permitting the falling of the impact weight rather than reducing its momentum; (3) the system maintains tension on the cable to avoid difficulties with loose cable jumping pulley tracks or the like at impact; (4) the release of hydraulic fluid from the cylinder through a relief valve is aided by gravity; (5) the compaction apparatus operates with equipment already in the possession of many construction companies rather than requiring a special vehicle; and (6) a higher number of impactions or cycles per minute than prior art compaction apparatuses and methods and permits greater force at the impaction surface with the same weight.

SUMMARY OF THE DRAWINGS

The above noted and other features of the invention will be better understood from the following detailed description, when considered with reference to the accompanying drawings, in which.

DETAILED DESCRIPTION

Figure 1:
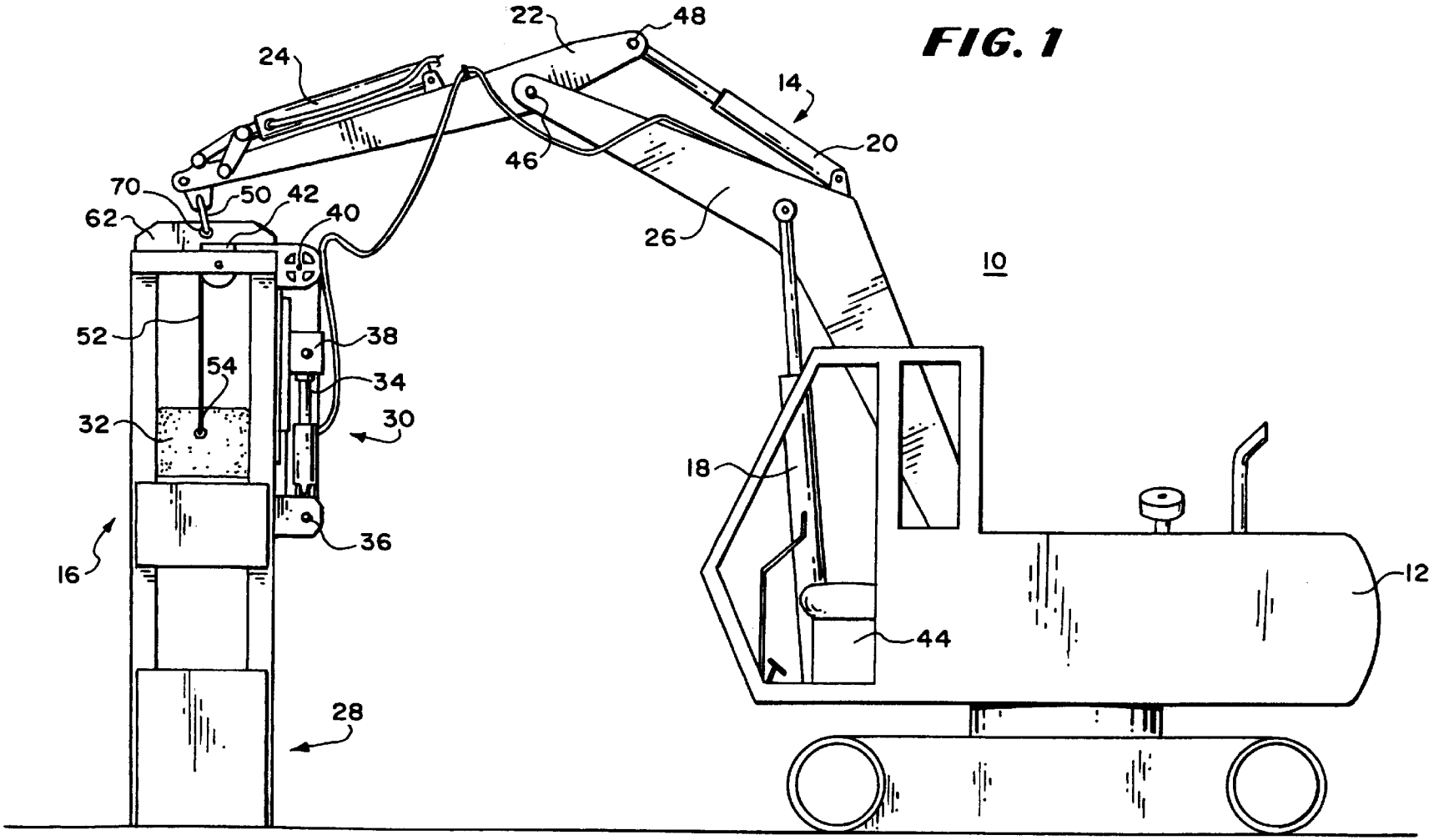
FIG. 1 is an elevational view of an apparatus for compacting or crushing surfaces in accordance with an embodiment of the invention.

In FIG. 1, there is shown an elevational view of a compaction system 10 having an excavation vehicle 12, a backhoe 14 and an impaction assembly 16. The backhoe 14 is easily connected to the compaction system 10 so that the backhoe 14 is carried by the excavation vehicle 12 along with hydraulic pumps or the like and the distal end of the backhoe 14 carries and operates the impaction assembly 16. In operation, the excavation vehicle 12 positions the impaction assembly 16 over the location where soil is to be compacted. The backhoe holds the impaction assembly 16 over or sets it down at that location and the hydraulic cylinder and backhoe 14 operate the weight within the impaction assembly 16 to pack earth. Thus, the excavation vehicle 12 may straddle a trench and move the impaction assembly 16 from adjacent position to adjacent position in the trench while impacting the earth.

The excavation vehicle 12 may be any conventional excavation vehicle and instead of an excavation vehicle, other vehicles may be used such as a truck or the like suitable for supporting a backhoe or other lifting apparatus and power equipment such as a hydraulic pump, or, in some unusual applications, electric motors or generators.

The backhoe assembly 14 includes a boom 26, a stick 22 and a hydraulic cylinder assembly. The hydraulic cylinder assembly includes a boom cyclinder 18, a crowd cylinder 20 and a bucket cylinder 24. The boom 26 is mounted at one end to the excavation vehicle 12. The boom cylinder 18 is mounted at one end to the excavation vehicle 12 and is pivotably mounted at the other end (piston end) to the boom 26 to articulate the boom 26 about a pivot point that mounts it to the excavation vehicle 12. The source of hydraulic pressure such as the hydraulic motor and reservoir or the source of electric power is mounted to the truck as shown at 44. It is connected by hoses to the cylinders.

The stick 22 is pivoted at 46 to the distal end of the boom 26. The crowd cylinder 20 is mounted at one end to the boom 26 and is pivotably mounted at its other end (piston end) to the end of the stick 22 as shown at 48. The stick 22 mounts the bucket cylinder 24. The bucket cylinder 24 is capped and not used herein and has at its distal end a shackle or other fastener 50 which is connected to a steel frame 28 of the impaction assembly 16 to lift the impaction assembly 16 for movement from location to location. One end of a cable 52 is anchored at 54 to a weight 32. A lift cylinder 34 and a pulley assembly 36 are mounted to the steel frame 28. Hydraulic hoses (to be described hereinafter) communicate with each of the operating cylinders 18, 20, 24 and 34 and with the hydraulic pressure source 44.

In operation, the hydraulic boom cylinder 18 lifts the boom 26 when the impaction assembly 16 is to be moved from place to place. The hydraulic crowd cyclinder 20 articulates the stick 22 to aid in positioning the frame 28. A movable pulley set 38 to be described hereinafter is driven by the hydraulic lift cylinder 34 to move the movable pulley set 38 or sheave assembly in such a way that a relatively short movement of the pulley or sheave set 38 on the piston of the lift cylinder 34 results in a large movement of the cable 52 and the weight 32 to which it is fastened.

The impaction assembly 16 includes the steel frame 28, the lift cylinder 34, a pulley assembly 30 and the weight 32. The pulley assembly 30 includes the lower pulley set 36 including a plurality of independently rotating pulleys on a common axle, a movable pulley set 38 including a plurality of pulleys independently rotating on a common pin, a corner pulley 40 and a center pulley 42. The lift cylinder 34 is mounted at one end to the frame 28 such as at 36 and extends upwardly with its piston end securely mounted to the movable pulley set 38. The lower pulley set 36 is also mounted to the frame in juxtaposition with the lower end of the cylinder so that when the piston moves upwardly and downwardly, the lower pulley set 36 and the movable pulley set 38 are moved apart or closer together.

The lower pulley set 36 includes five pulleys and the movable lift pulley set 38 includes four pulleys for nine turns of the cable 52 forming nine lengths of the cable between the two pulleys in the preferred embodiment but may include more or fewer pulleys depending on the multiplication factor to be applied between the linear motion of the piston and the length of movement of the cable 52, resulting in a linear motion of the weight 32. Thus, a multiplication factor of nine is provided in the preferred embodiment between the motion of the tip and the motion of the weight. The cable 52 extends repeatedly from the movable pulley set 38 to which one end is anchored over the lower pulley set 36 to form the nine loops and from the lower pulley set 36 over the corner pulley 40 and the center pulley 42, after which the other end is connected at the weight 32.

With this arrangement, as the piston of the lift cylinder 34 extends itself, the cable 52 is shortened on the distance between the lower pulley set 36, and the movable pulley set 38 increases so as to extend the 9 strands between them, thus shortening the length of cable 52 leading to the weight by nine times the movement of the piston and causing the weight 32 to be lifted. Upon release, the relief valve of the solenoid activated valve 110 (FIG. 11) opens and fluid begins draining out as both the movable pulley set 38 and the weight 32 drop downwardly until the weight 32 hits the impact surface at the bottom of the impaction assembly 16.

Figure 4:
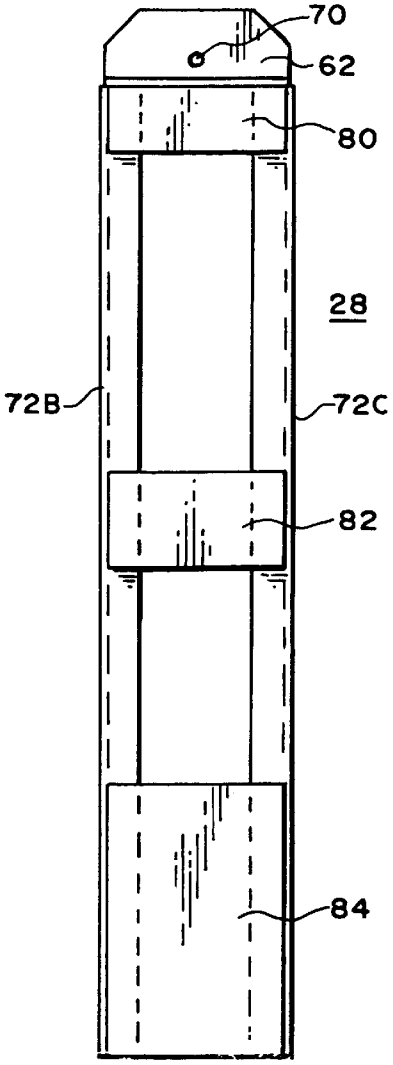
FIG. 4 is a left side, elevational view of the impaction apparatus of FIG. 2.
Figure 3:
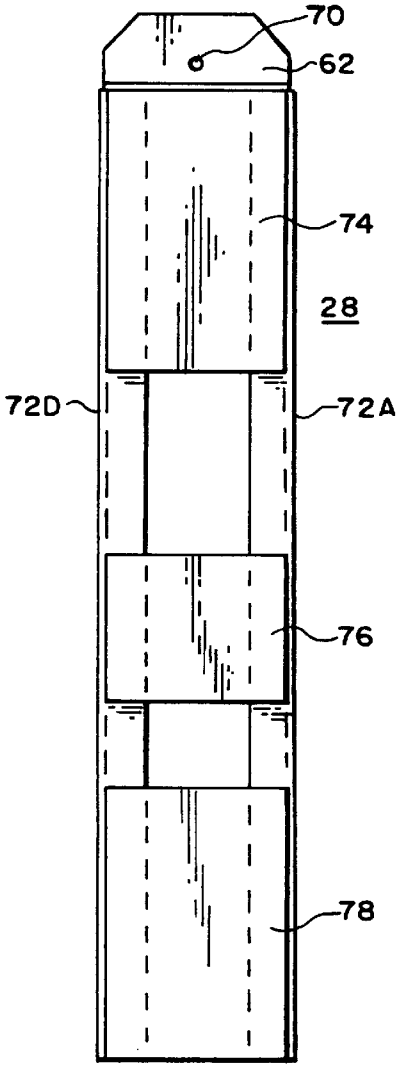
FIG. 3 is a right side, elevational view of the impaction apparatus of FIG. 2.
Figure 2:
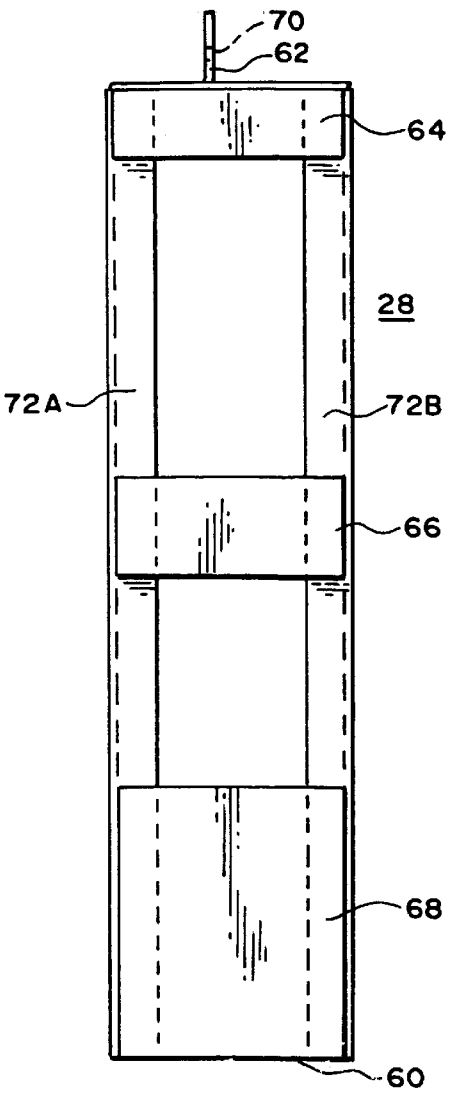
FIG. 2 is a front, elevational view of an impaction assembly used in the embodiment of FIG. 1.

In FIG. 2, there is shown an elevational, side view of the steel frame 28 of the impaction assembly 16 (FIG. 1), which side, elevational view is identical to its opposite side view. A front, elevational view of the steel frame 28 facing the excavation vehicle 12 (FIG. 1) is shown in FIG. 3 and a rear, elevational view of the rear plate of the steel frame 28 is shown in FIG. 4. As shown in FIGS. 2–4, the corners of the steel frame are formed of angle irons 72A—72D, has an open bottom 60 for the weight to drop through onto the impact area and a fin 62 at the top with an opening 70 for fastening to the end of the backhoe stick 22 to permit the stick 22 (FIG. 1) to lift the frame 28 when the excavation vehicle 12 is moving the impaction assembly 16 from place to place and to hold it above the impact site where it may be moved from place to place on the impact site with the backhoe 14.

The steel frame 28 is 14 feet and one inch tall from the top to the bottom of the steel frame, excluding the fin 62. The sides are formed of the two angle irons 72A and 72B spaced two feet, three and one-half inches from each other corner to corner. The front is formed of the two angle irons 72D and 72A spaced one foot ten inches from each other corner to corner. The back corner angle irons defined by the corners between the angle iron 72B and 72C are spaced the same distance to form a parallelopiped that is one foot ten inches by two feet three and one-half inches by 14 feet one inch in dimensions.

To support the sides of the steel frame 28, a set of 12 bracing plates of one-half inch thick steel are used with three plates serving as braces on each side. For each of the two sides, there is a bottom plate shown at 68 in FIG. 2 having a width of two feet two inches and a vertical height of three feet six inches. There is a plate 66 separated from the bottom plate but vertically above it which has a width of two feet two inches and a height of 12 inches and there is a top member 64 separated from the plate 66 but vertically above it having a width of two feet two inches and a height of six inches. The front side (FIG. 3) has a bottom plate 78 having a width of 21 inches and a height of three feet six inches, a middle plate 76 having a width of 21 inches and a height of one foot six inches and a top plate 74 having a width of 21 inches and a height of three feet six inches. The rear side (FIG. 4) has a bracing plate 84 at the bottom having a width of 21 inches and a height of three feet six inches, a center plate 82 having a width of one foot nine inches and a height of 12 inches and a top plate 80 having a width of one foot nine inches with a height of six inches. The angle irons are type five by five and ¾ by 13 feet six inch angle irons.

Figure 6:
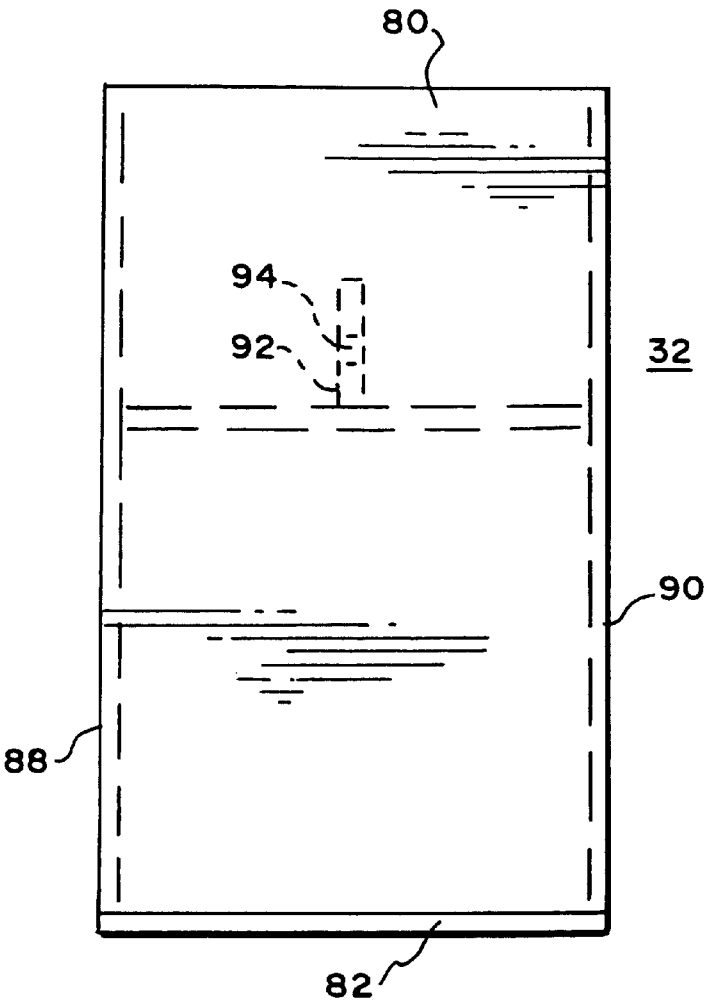
FIG. 6 is a side view of the weight of FIG. 5.
Figure 5:
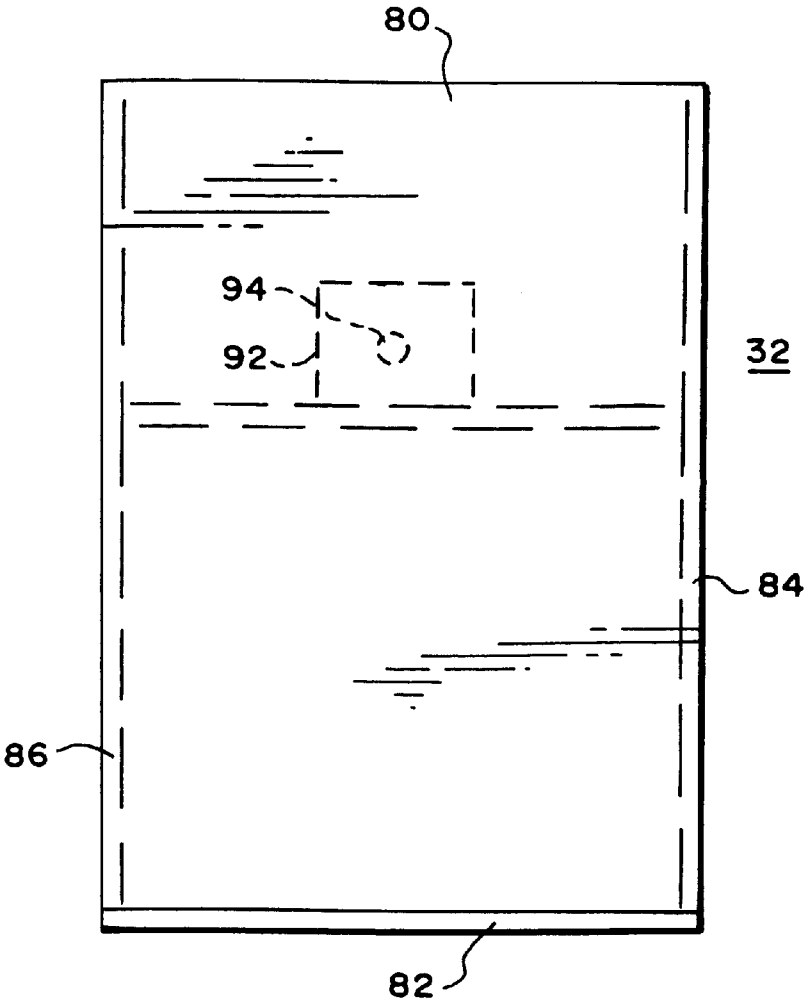
FIG. 5 is a front view of a weight usable in the impaction apparatus of FIG. 2.

In FIGS. 5 and 6, there are shown a side view and front view respectively of the weight 32, which is formed of ¾ inch steel shaped as a parallelopiped with an open top 80, a ¾ inch steel bottom 82, front and rear ¾ inch steel plates 84 and 86 (FIG. 5) spaced from each other 2.2 inches from outer side to outer side and having a height of three feet six inches, and side plates 88 and 90 (FIG. 6) spaced one foot eight inches from each other and having a three feet six inch height. A four inch by ¾ inch by six inch steel plate 92 is mounted to a ½ inch steel top plate welded partway into the parallelopiped weight 32 to be vertical and to have an opening 94 to which the cable 52 (FIG. 1) may be attached to raise and lower the weight 32. The bottom portion is permanently filled with weights and the top portion may be filled to increase the weight as desired.

Figure 7:
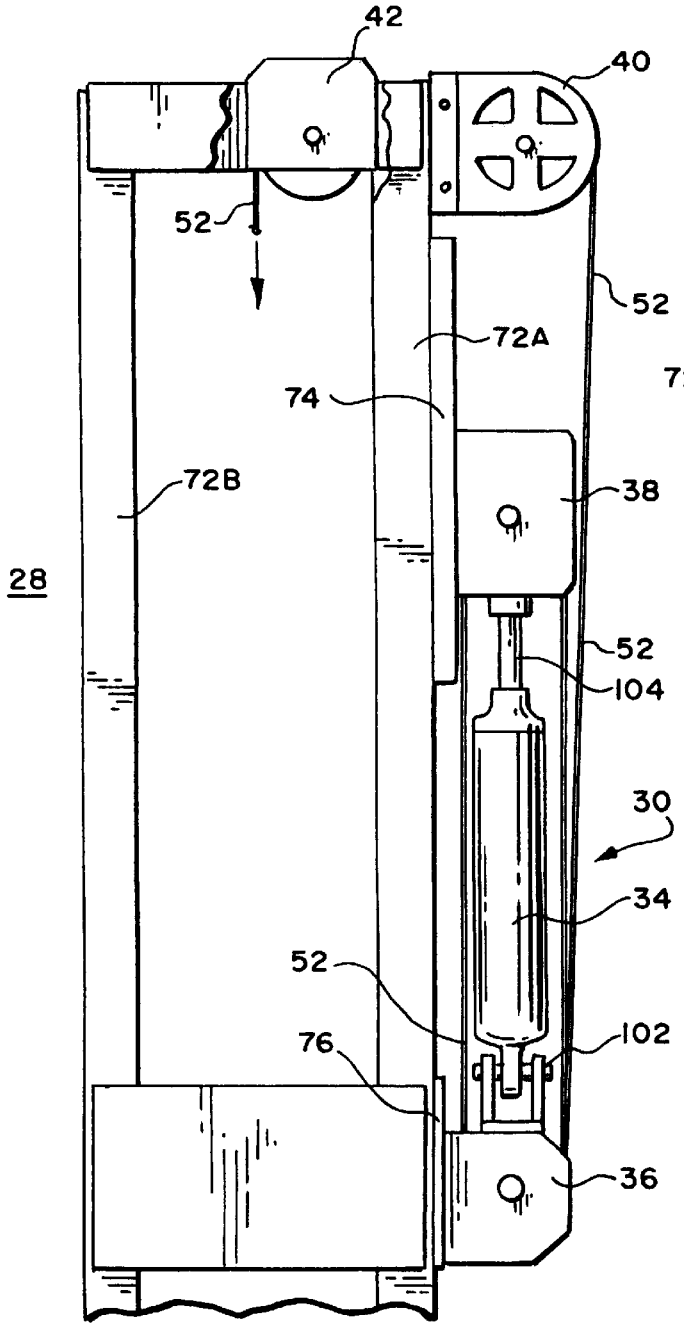
FIG. 7 is a fragmentary, side view of an impaction assembly in accordance with the embodiment of FIG. 1.

In FIG. 7, there is shown a fragmentary, elevational view of the side of the steel frame 28 with the lift cylinder 34 and the pulley assembly 30 mounted to it so that the lower fixed pulley assembly 36 is mounted to the middle plate 76 with lift cylinder 34 being mounted pivotably at its bottom near the fixed pulley assembly 36 as shown at 102 and its upper piston 104 being mounted to the movable pulley set 38 which moves upwardly and downwardly within guides as fluid drives it upwardly or downwardly depending on the position of a valve (not shown in FIG. 7). The cable 52 is wound between the pulleys of fixed and moving pulley sets 36 and 38 passing five times over the fixed pulley set 36 and passing four times over the movable pulley set 38 so that as the fixed pulley set 36 moves upwardly, the length of cable 52 between the two is increased by a multiple of nine times the distance that the pulley set 38 moves to raise and lower the weight 32 attached to the cable 52. From the lower fixed pulley set 36, one strand of the cable 52 extends upwardly around the corner pulley 40 to the center pulley 42 where it extends downwardly and may be connected to the weight 32 to raise and lower the weight 32.

Figure 8:
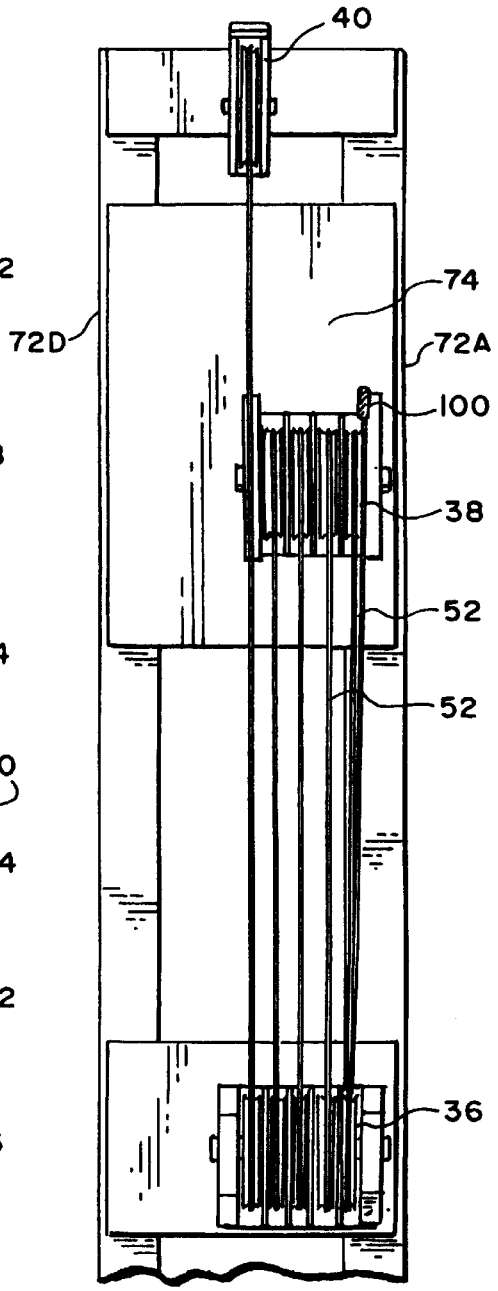
FIG. 8 is a front view of the embodiment of FIG. 7.

In FIG. 8, there is shown a fragmentary, elevational view showing the front side of the lift cylinder 34 and the pulley assembly 30 corresponding to FIG. 7. As shown in this view, the cable 52 is wound around the pulleys 36 and 38 so that as the movable pulley set 38 moves upwardly, the cable 52 pulls downwardly around the corner pulley 40 by a multiple of nine times the distance the pulley set 38 moves upwardly. However, when the pulley set 38 moves downwardly, the weight 32 pulls the cable 52 to keep it taunt so that both the weight 32 and the pulley set 38 are dropping downwardly draining the hydraulic oil from an hydraulic lift piston. As the piston moves upwardly, it pulls the weight 32 upwardly against its own weight under the force of the fluid from a hydraulic motor. The end of the cable 52 is anchored at 100 to the top of the movable pulley set 38.

Figure 9:
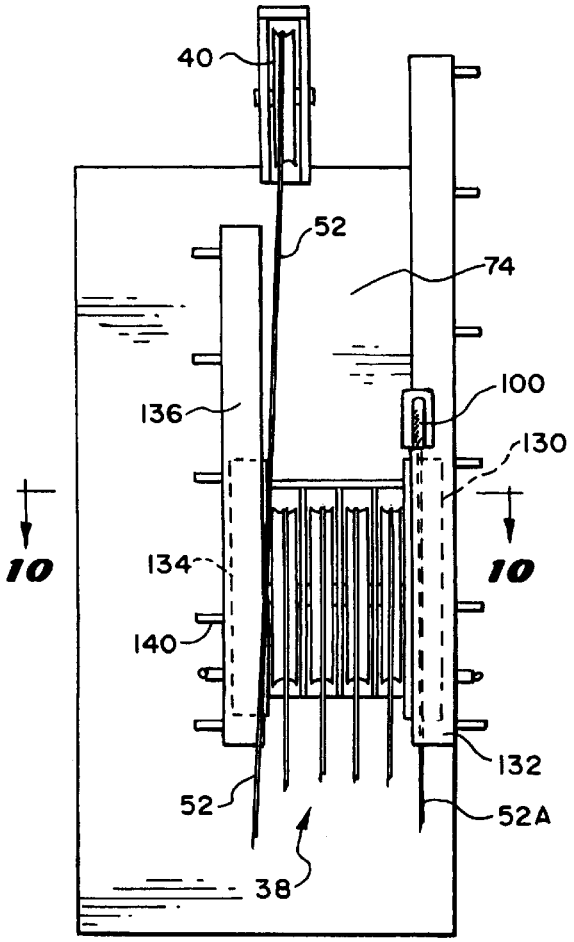
FIG. 9 is a fragmentary, front, elevational view of a pulley mounted to an impact apparatus in accordance with the embodiment of FIG. 1.

In FIG. 9, there is shown a fragmentary, elevational view of the movable pulley set 38 mounted to the top steel plate 74 welded to the frame as shown in FIG. 8. One end of the cable 52 is anchored at 100 adjacent to a tubular member 130 that slides within an angle iron 132 welded to the top plate 74. The other end of the cable 52 extends upwardly from the lower fixed pulley set 36 (FIG. 8) and passes beyond the movable pulley set 38 extending upwardly to the corner pulley 40. A second tubular member 134 extends slideably under a second angle iron 136. The tubular members 134 and 130 are greased to slide readily under the angle irons 132 and 136 which are welded to the top plate 74. The tubular members 130 and 134 are welded to the movable pulley set 38 to move therewith and the tube 100 containing the anchor receives the beginning strand which then passes downwardly to the lower pulley set 36 and upwardly in the first loop shown by the cable passing through the end of the tube 130 at 52A. The angle irons 132 and 136 are supported by metal members such as the one shown at 140 to provide bracing. These members are welded both to the angle irons and to the top plate 74.

Figure 10:
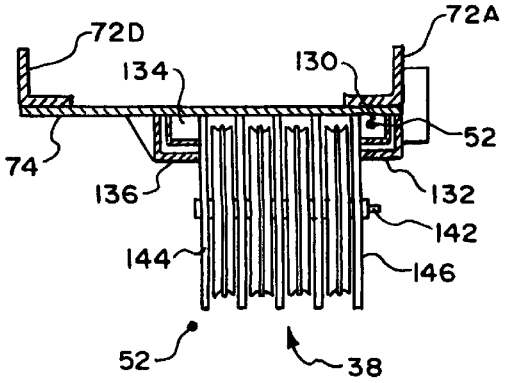
FIG. 10 is a simplified sectional view through lines 10—10 of FIG. 9.

In FIG. 10, there is shown a sectional view through lines 10—10 of FIG. 9 showing the four independently rotatable pulleys of the upper movable pulley set 38 mounted on a greased fitting 142 for rotation. Side frame members 144 and 146 are welded to the tubular members 134 and 130 with the cable 52 passing through the tubular member 130. The tubular members 134 and 130 are captured within the angle irons 136 and 132 respectively for sliding there within.

Figure 11:
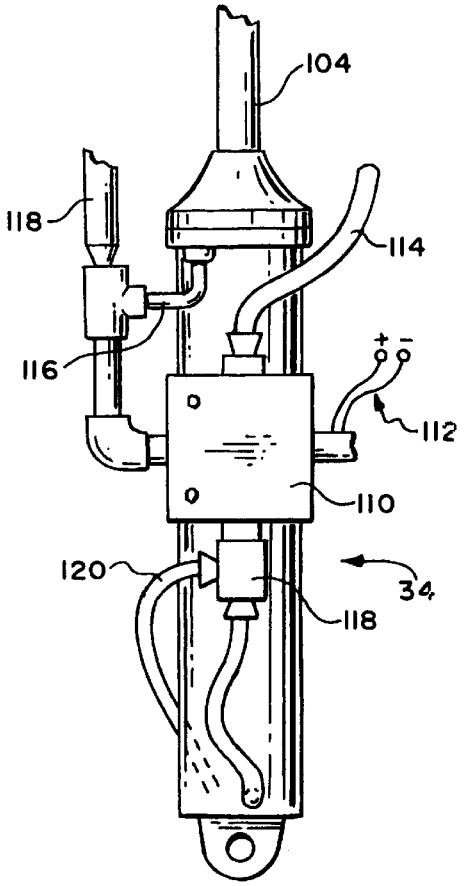
FIG. 11 is a fragmentary view of a valve and hydraulic cylinder usable in the embodiment of FIG. 1.

In FIG. 11, there is shown a fragmentary view of the double acting hydraulic lift cylinder 34 with a solenoid operated hydraulic valve 110 mounted to it to form hydraulic connections at a location adjacent to the lift cylinder 34 and able to keep free from the moving parts of the piston. As shown in this view, when the solenoid valve 110 is closed by a voltage applied to conductors 112, hydraulic fluid from an inlet hose 114 forces the lift cylinder piston 104 upwardly by providing a hydraulic fluid pressure supplied by the excavation vehicle 12 through conduits 120 and 118. When the solenoid 110 is opened, the lift cylinder piston 104 is forced downwardly by the weight 32 (FIG. 1) that pulls the movable and lower pulley sets 38 and 36 together and the hydraulic oil is returned to the excavation vehicle's reservoir through the conduits 118 and 120 which are parallel to each other. The conduits 118 and 120 are ¾ inch hoses that extend to the base of the lift cylinder (which could be replaced by one single one-inch opening conduit) and permit the return of oil through the conduit from the base of the cylinder and in a regenerative fashion additionally supplying oil to the top of the lift cylinder 34.

As can be understood from the above description, the apparatus and method for compacting has several advantages, such as: (1) it operates rapidly; (2) the downward movement of the weight is aided by downward force of gravity acting on all parts (including the anchored end of the cable) that move with the movable pulley rather than acting against gravity; (3) the valve is open to allow fluid to escape the volume under the cylinder piston and enter the volume above the cylinder piston in addition to returning to the vehicle hydraulic pump reservoir during the draining operation and the dropping of the weight; (4) the cables maintain tension because they are against the weight and over the top and centered for the impact cage; and (5) the compact assembly may be used with standard backhoes and excavation vehicles, thus reducing the need to purchase new equipment.

What is claimed is:

1. A method of raising and lowering an object, comprising the steps of:

connecting the object to a first end of a flexible member, said flexible member having first and second ends;

raising and lowering the object by the flexible member;

said flexible member being wound around a first pulley means and a second pulley means with the second end of said flexible member being anchored to one of said first and second pulley means;

changing a position of said first and second pulley means with respect to each other to raise or lower the second end of the flexible member;

said step of changing a position of said first and second pulley means with respect to the other of said first and second pulley means to change a position of the second end of the flexible member wherein said one of said first or second pulley means pulls the second end of said flexible member downwardly by gravity as said object moves downwardly;

connecting a backhoe to a vertical frame; moving the vertical frame to a location needing compaction; and lowering the vertical frame onto the ground; the step of raising and lowering the object including the substep of raising and lowering the object within the vertical frame wherein the first and second pulley means are mounted to the vertical frame.

* * * * *